US006208588B1

(12) United States Patent
Ferness

(10) Patent No.: US 6,208,588 B1
(45) Date of Patent: Mar. 27, 2001

(54) DEPTH SPHERE

(75) Inventor: Sergio Ferness, 3904 Crestwood Dr., Northbrook, IL (US) 60062

(73) Assignee: Sergio Ferness, Northbrook, IL (US)

( * ) Notice: Subject to any disclaimer, the term of this patent is extended or adjusted under 35 U.S.C. 154(b) by 0 days.

(21) Appl. No.: 09/271,632

(22) Filed: Mar. 17, 1999

Related U.S. Application Data

(60) Provisional application No. 60/078,656, filed on Mar. 19, 1998.

(51) Int. Cl.[7] ..... G01S 15/00
(52) U.S. Cl. ..... 367/108
(58) Field of Search ..... 367/99, 108, 908, 367/111, 165, 173, 188; 43/17.1; 73/292; 340/622; 181/124

(56) References Cited

U.S. PATENT DOCUMENTS

| | | | | |
|---|---|---|---|---|
| 4,805,337 | * | 2/1989 | Kurata | 43/17.1 |
| 4,943,951 | * | 7/1990 | Leavell et al. | 367/111 |
| 5,594,707 | * | 1/1997 | Goto et al. | 367/111 |

* cited by examiner

*Primary Examiner*—Daniel T. Pihulic

(57) ABSTRACT

A compact self contained portable, buoyant, water depth and temperature recording device. Allowing the user to gather depth recordings for safety and sporting situations. With it's simplicity of use, portability, and minimal storability factors , makes the units capabilities of use extend beyond the present large and permanent mounted counterparts.

6 Claims, 5 Drawing Sheets

SIDE VIEW

ELEVATIONS
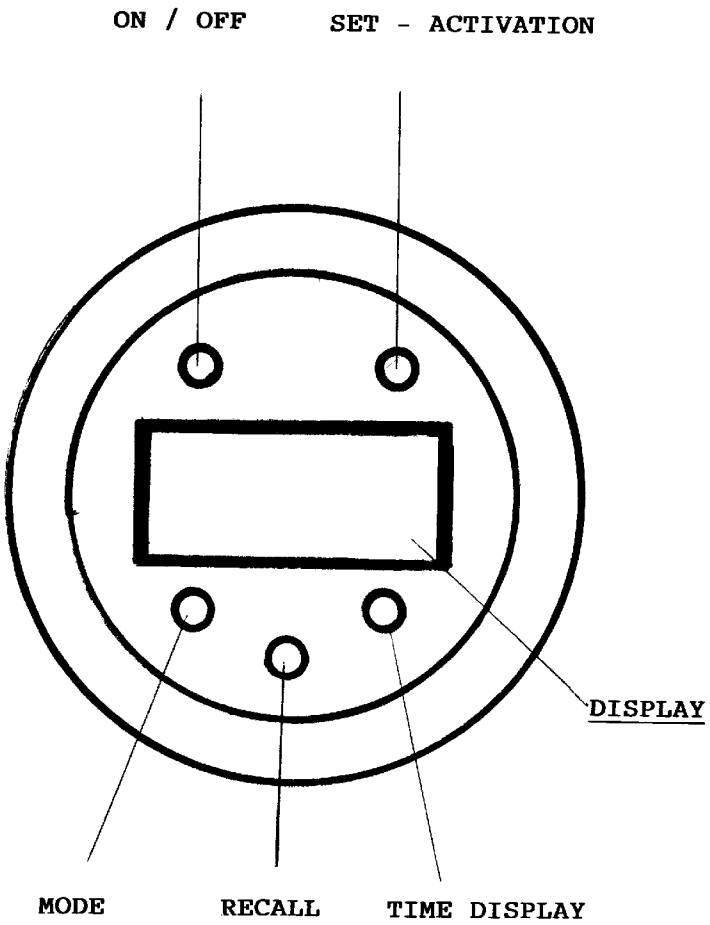
FIG B : B TOP VIEW
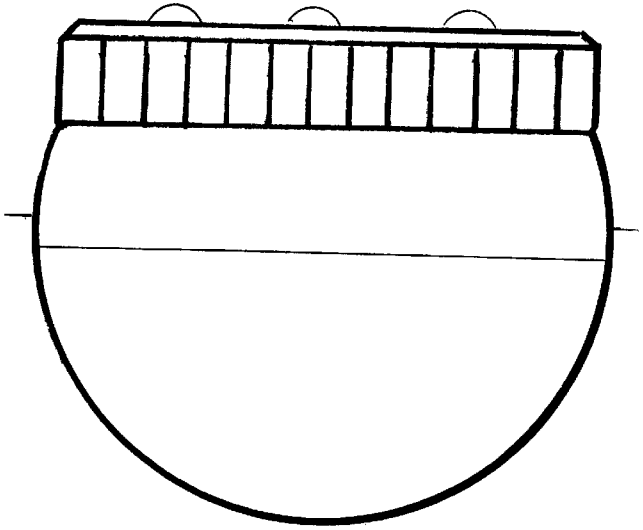
FIG : A SIDE VIEW

INTERIOR COMPONENTS
FIG. C
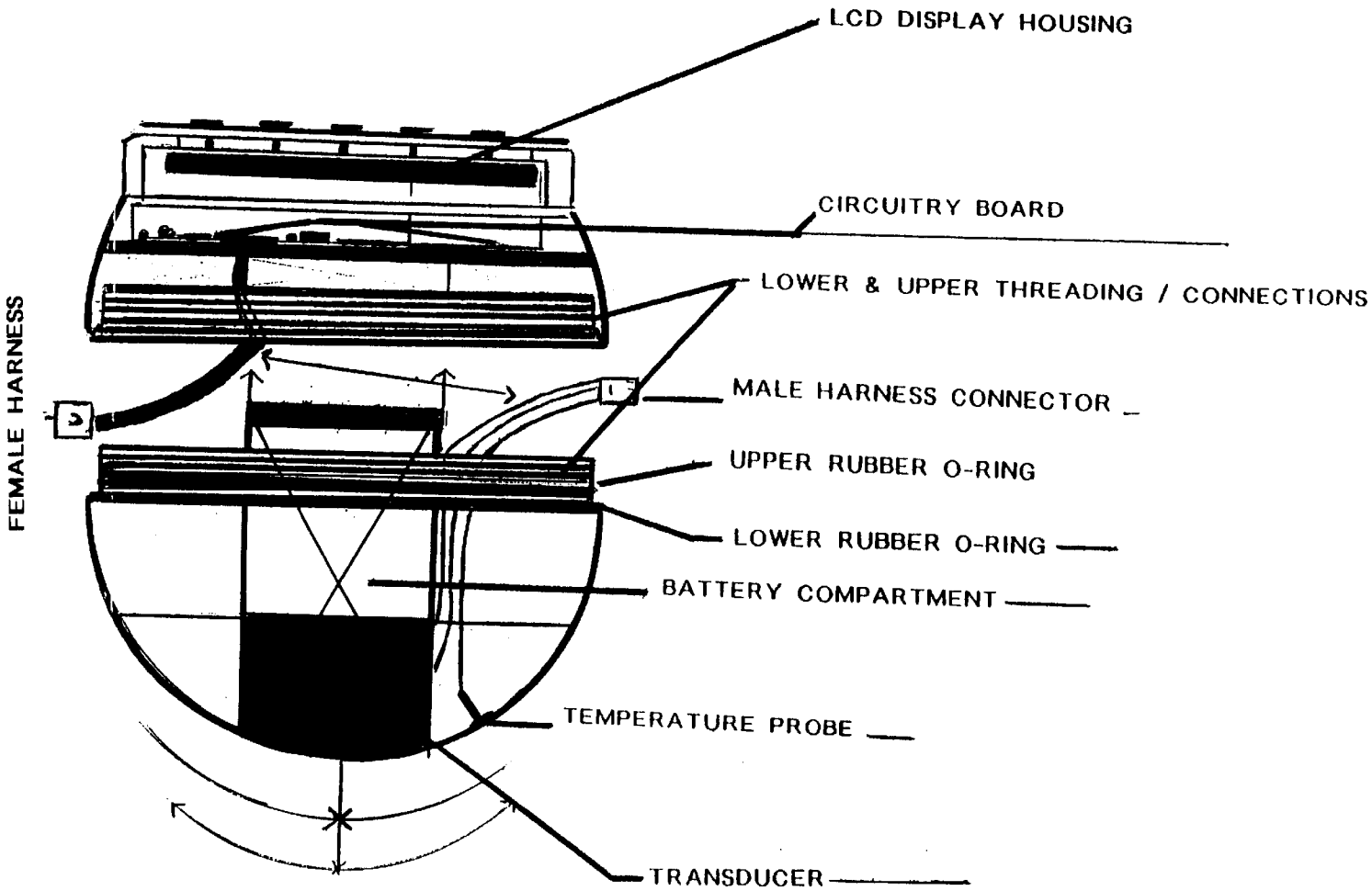

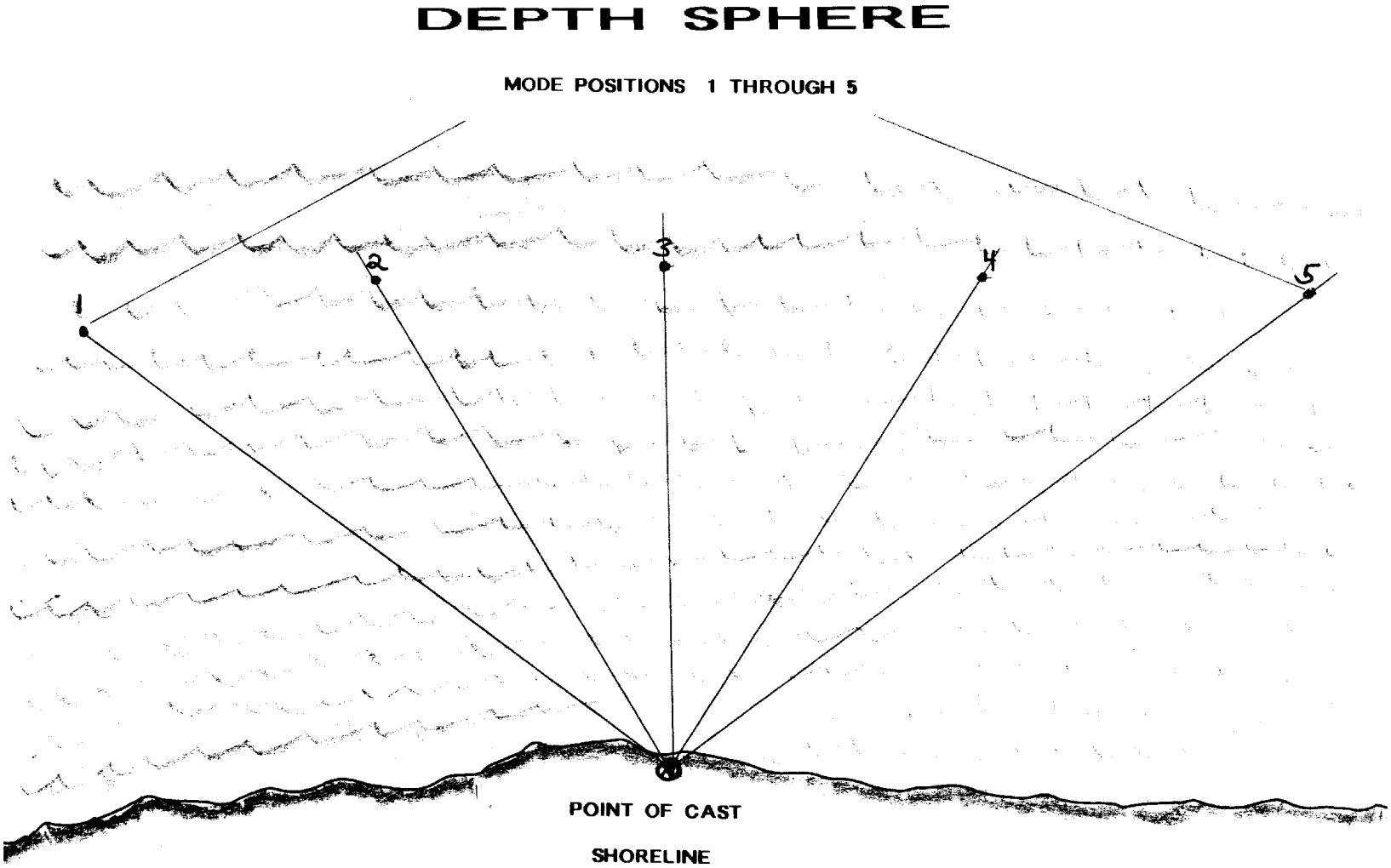
FIG. D

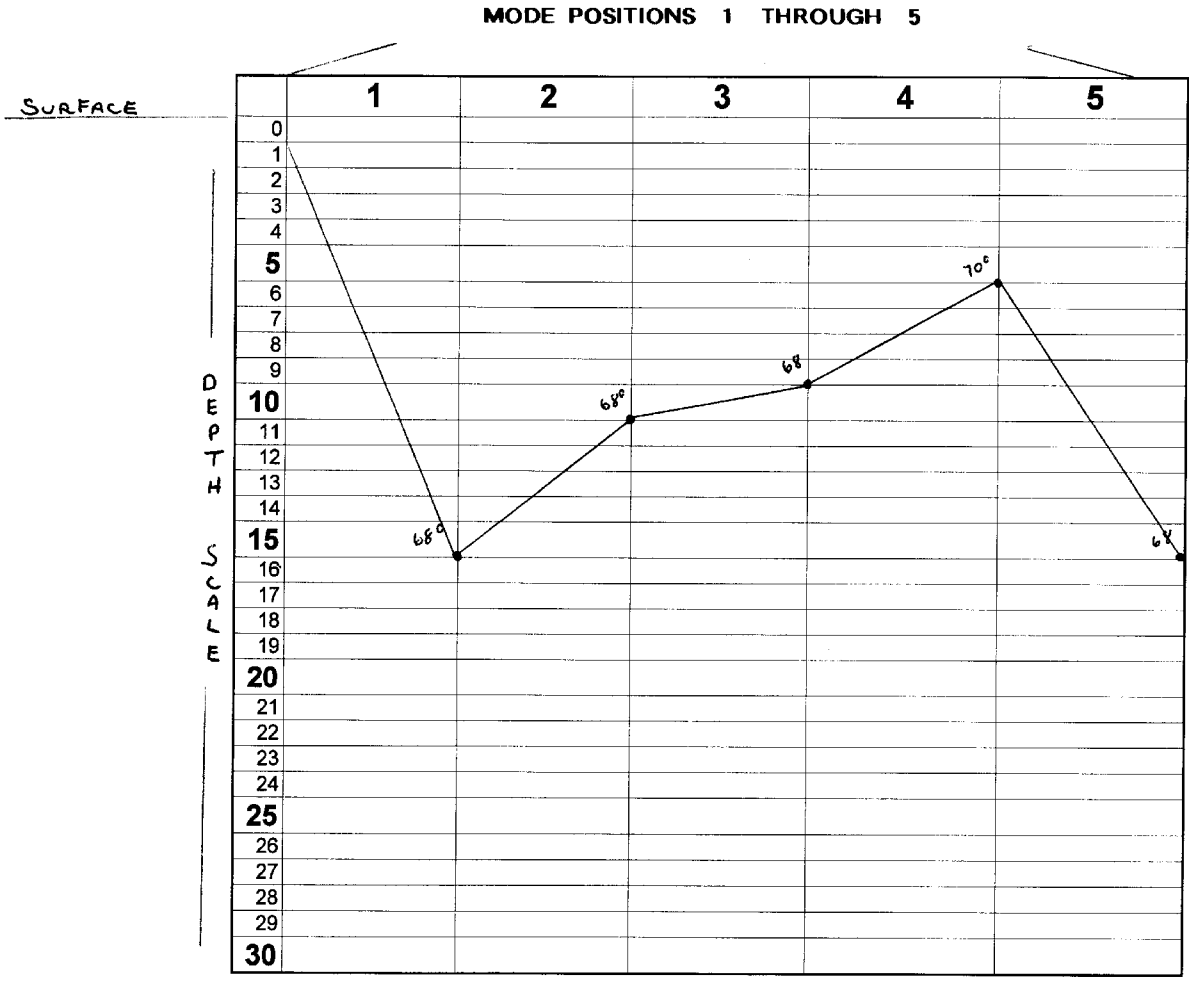
FIG. E
DEPTH SPHERE

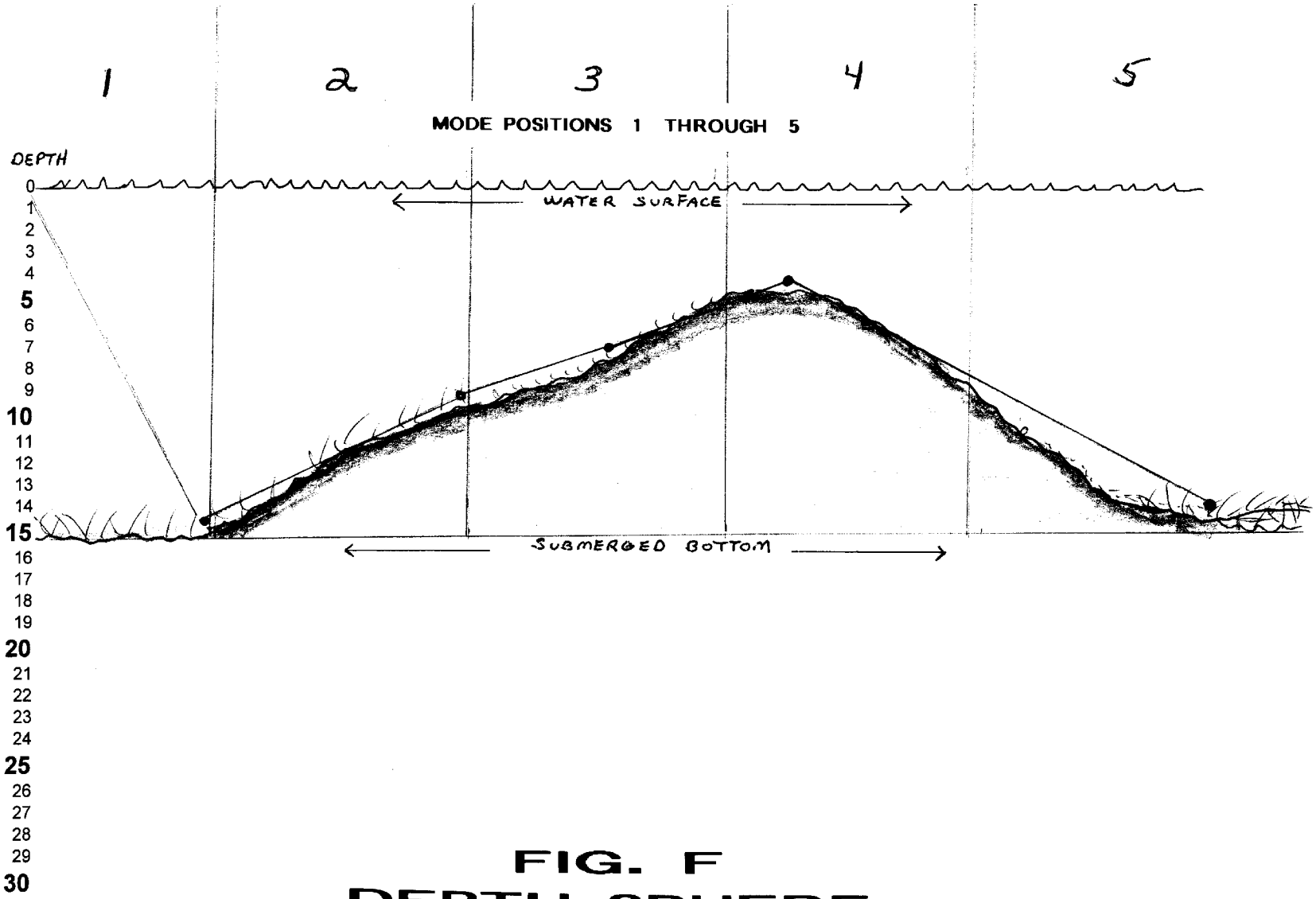
FIG. F
DEPTH SPHERE

DEPTH SPHERE

CROSS-REFERENCE TO RELATED APPLICATION

This application claims the benefit of U.S. Provisional Application No. 60/078,656, filed on Mar. 19, 1998.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

This invention relates to a completely compact, portable, and self contained device providing depth recordings or readings giving it's user vital information pertaining to depths in a body of water. Unlike stationary mounted systems on watercrafts, the Depth Sphere was designed for it's capabilities to record readings from shorelines, areas where the user cannot penetrate, have clear passage to, or hesitant to enter not knowing the depth.

The major advantage over it's counterparts on the market today is, it's capabilities to record water depths yet remaining compact, self contained, simplicity of use, portability, and storability. Thus, making the unit's capabilities of usage extend beyond it's counterparts.

BRIEF SUMMARY OF THE INVENTION

This invention is directed to a self contained, compact, and portable depth and temperature recording device. Where as the user can measure the depths and temperatures in a body or area of water by placing the unit at a given location, retrieved, and reading the desired areas measured depth, along with it's surface temperature.

BRIEF DESCRIPTION OF THE SEVERAL VIEWS OF THE DRAWINGS

Elevations. FIGS. A and B. Is a perspective view of the unit's side and top elevations depicting the units exterior designs and operational components.

Interior Components. FIG. C. Is a perspective view of the unit's interior depicting it's operational components.

FIGS. D, E, and F. Is a perspective exemplary view of the units chartable capabilities.

DETAILED DESCRIPTION OF THE INVENTION

The Depth Sphere consists of a sphere shaped, totally buoyant, two part water tight housings joined via machined screw type threading to form the unit. The housings shall be manufactured from durable, lightweight, shock resistant, non corrosive materials.

As shown on drawing of interior components, the lower unit contains a small transducer placed at it's bottom center axis. The transducer shall be sandwiched and adhered to housing using lightweight water resistant materials such as rubber based or silicone based substances. Next to the transducer is placed a temperature probe exiting the housing by the probes edge and flush with housing. Probe is totally water tight, sealed and sandwiched with the same materials as the transducer. Placed directly above the transducer is the battery compartment, sealed and adhered together with a snap type cap. Batteries shall be light weight yet containing enough energy output source to efficiently run the system.

The compartment, and the transducer are placed at the center vertical axis , as to consistently keep transducer facing downward with water motion for precise readings of sonar echo soundings (surface to bottom). At the top edge of the bottom housing is the threaded portion identified on drawing of Interior Components as Lower Threading Connection. Placed at this section of the housings are two rubber O-Rings creating water tight seals upon the joining of housings. The lower O-Ring is seated at lower edge of housing and is the final seal between the two housings. The upper O-Ring is slightly imbedded within a housing grove, and protruding past the threading as to deter the sections to unthread while in use. As the sections are brought together via male/female threading, this O-Ring has an increased friction against it's counterpart, thus making a snug tight seal. All connections are electronically connected via a male/female wire harness that separate lower and upper unit components.

Moving to the upper housing as shown on drawing of Interior Components, the next section is the receiving portion of the battery compartment. As the sections are brought together the top portion of the battery compartment enters this section of upper housing thus completely sealing energy source. Above that is placed the circuitry board containing micro chips, amplification source, and all circuitry needed to run the system. In the upper most section of this housing, is the LCD display housing with all switching connections.

How the Depth Sphere works: Refer to drawing of Elevations.

In standard operation the unit is activated by activating switch on/off as shown on FIG. B. This step only activates the LCD display and sets system on standby, as to not energize the transducer. As a safety feature, the activation of display only, and not energizing transducer prohibits the transducer from damage caused by the energizing under Non-Submerged situations. Pressing Time Delay switch the user will be able to set a time delay sequence ranging from 10 to 20 seconds depending on the desired delay timing. Once a setting has been chosen, this will be the delay timing from the initial set activation, to the time the transducer energizes and transmits it's pulse. Pressing the Set switch the unit will commence the countdown as set per the time delay, and will fully activate upon reaching it's set timing.

In sequence and under standard operations the procedure for use would be as follows: Turn unit On, Choose Time Delay, Press the Set switch, place unit at desired location, wait for the elapsed timing as set by the time delay, retrieve unit, read display for depth and surface water temperature.

Note: Under normal situations it will not be necessary to set time delay feature unless a higher setting is required. By default the unit will always use the ten second delay.

Added feature capabilities: In many instances the user may require to recall depths of certain areas as desired. For that reason, the Depth Sphere shall have the capabilities for that memory process by the use of the mode and recall switch as shown on FIG. B.

Mode switch: this feature is used when the user desires to pan, graph, or store location settings. The Depth Sphere can store five points or locations and can be recalled as a particular point as desired. By pressing the mode switch the numbers 1 through 5 will begin flashing on the units display. By pressing mode again mode's 2 through 5 will deactivate and only mode 1 will now be active and on standby to record. After full activation and the energizing of the transducer has taken place, mode 1 will be full or occupied in the units memory and will not activate again until cleared. (accomplished by pressing mode and leaving pressed for five seconds). By pressing the mode switch again, mode's 2 through 5 will begin flashing pressing mode again, mode 2 is now activated and on standby. Repeating these steps all five mode locations can be stored.

Recall: Recalling any mode location is accomplished with ease by simply pressing the recall switch as shown on FIG. B: Pressing the recall switch will display the corresponding mode 1, 2, 3, 4, or 5. The depth recorded for that location, the surface water temperature, and the time delay chosen. If no mode locations are occupied in memory the unit will transmit "mode empty" for two seconds.

This example is referenced to a sportsman fishing from a shoreline, and the desired outcome of collected readings is to get an overview of the area where that sportsman is fishing. It is desired to create a contour graph of a span of area directly present within the area presently being fished, thus allowing the user to vary, or place the bait within the proper depth.

In stationary units such as depth locators, or fish finders permanently mounted on watercrafts, as the craft moves along the water, the sonar echoes are received and displayed in real time. As the vessel passes over areas that are preferred fishing spots, these areas are displayed as bottom contour displays showing fish, weed beds, and all other objects detected by the sonar's sound waves. The basic principle is used by the Depth Sphere, while not in real time scenario or as an instant and continues display factor, a fair and accurate overview can be measured by the using in addition the Mode feature (mode switch FIG. B) and Recall feature (recall switch FIG. B).

FIG. D: In this drawing an exemplary view is depicted as a body of water where an individual will place the Depth Sphere at five different locations. Locations 1 through 5 are the five areas that are also referenced by the unit as mode settings 1 through 5.

FIG. E: In this drawing an exemplary view is depicted as a simple graph scale marked by depth's in increments of five feet as shown on the left border, with mode reference points on the top as shown from 1 to 5.

Sequence of Operation: Turn unit On. Press Time Delay to desired timing. Press the Mode switch assuring that the unit is displaying mode location 1. Press the Set switch and cast or place the unit at the desired location referenced on FIG. D: as location 1. Wait for elapsed time delay and retrieve. Repeating these steps assuring that the proper mode location or number is displayed, the user can now proceed to enter the collected data on the graph FIG. E.

As shown on FIG. E, five locations were chosen and accordingly five mode settings were stored. Mode 1 stored data as fifteen feet of depth, with a surface temperature of 68 degrees F. Mode 2 stored at ten feet with 68 degrees F. Mode 3 stored at nine feet with 68 degrees F. Mode 4 stored at five feet with 70 degrees F. Mode 5 stored at 15 feet with 68 degrees F.

Graphing the collected data is a simple process performed as follows. Press the Recall switch FIG. B: Position 1 is now displayed together with it's corresponding data. In this example the readings are fifteen feet of water depth, with a surface water temperature of 68 degrees F. Enter data on graph as shown on FIG. E by a simple dot at the corresponding depth for that location mode. Press recall again and mode 2 is displayed, enter data. Repeating these steps all five mode locations are now entered. Connecting all mode locations, a simple contour graph of the desired area has been accomplished.

Referencing the contour graph created, FIG. F depicts a side view of what is visualized on the graph. Since Mode 1 was at fifteen feet and as we recorded modes 2, 3, 4, and five, we can visualize a rise in bottom depths, then a drop back to fifteen feet at mode 5. This normally defines a submerged island and recorded with true time factors on vessel units.

While this is an added feature with the fishermen in mind it's uses are left to the user's own needs and desires. Nevertheless the Depth Sphere will be a vital tool for many uses, and an added safety feature for many individuals venturing in the areas where knowledge of depth is needed.

I claim:

1. A portable, compact, buoyant, self contained device used to record and display depth and water temperatures comprising: a housing having it's own self contained transducer, energy source, temperature recording probe, circuitry's, and display.

2. The device of claim 1 wherein: the housing is a lightweight shock resistant and non corrosive materials containing it's own buoyant properties; the device is separated within two housings containing all operable components; housings are joined via machined screw threading and, operable contacts via a wire harness electronically joining transducer, temperature probe, and energy source to circuitry and display; water tight seals are accomplished by the use of rubber O-rings; one O-ring acting as a seat for the housings, and the other as a final and friction seal, and retrievable by means of fishing lines, lanyard or rope riggings attached to permanently mounted retrieval component of the device.

3. The device of claim 1 wherein: said housing has a sphere shape that becomes a triangular or coned shape containing the transducer at it's lowest submerged point with upper portion of device being of greater circumference ratio as to create added stability and buoyancy.

4. The device of claim 1 wherein: said wire harness contacts are modified by solid bottom and upper housing plates containing measured contact points; whereas the housings are joined via the turning and engagement of their threading counterparts, the contact points on plates align and electronic contact is achieved for operations.

5. The device of claim 1 wherein: said retrieval means is replaced by dual purpose rigging containing within electrical wiring connected from buoyant housing to display device not making contact with the water; whereas the user would place the buoyant device in the area of water, the unit would record the desired depth and temperature, and transmit data to the display.

6. The device of claim 1 wherein: energy source life is extended, and device housings are less frequently separated by means of rechargeable contacts between device and charging source.

* * * * *